US011885217B2

(12) United States Patent
Martens et al.

(10) Patent No.: US 11,885,217 B2
(45) Date of Patent: Jan. 30, 2024

(54) APPARATUS FOR AND METHOD OF MONITORING A DRILLING INSTALLATION

(71) Applicant: AKER SOLUTIONS AS, Lysaker (NO)

(72) Inventors: Joakim Martens, Oslo (NO); Geir Ivar Holberg, Oslo (NO); Martin Pedersen, Oslo (NO)

(73) Assignee: AKER SOLUTIONS AS, Lysaker (NO)

( * ) Notice: Subject to any disclaimer, the term of this patent is extended or adjusted under 35 U.S.C. 154(b) by 29 days.

(21) Appl. No.: 17/791,215

(22) PCT Filed: Jan. 8, 2021

(86) PCT No.: PCT/NO2021/050005
§ 371 (c)(1),
(2) Date: Jul. 7, 2022

(87) PCT Pub. No.: WO2021/141499
PCT Pub. Date: Jul. 15, 2021

(65) Prior Publication Data

US 2023/0340871 A1 Oct. 26, 2023

(30) Foreign Application Priority Data

Jan. 9, 2020 (GB) ..... 2000272

(51) Int. Cl.
*E21B 47/117* (2012.01)
*E21B 33/043* (2006.01)

(52) U.S. Cl.
CPC ..... *E21B 47/117* (2020.05); *E21B 33/043* (2013.01)

(58) Field of Classification Search
CPC ..... E21B 47/117; E21B 33/043
See application file for complete search history.

(56) References Cited

U.S. PATENT DOCUMENTS

2006/0117838 A1* 6/2006 Williams ..... G01M 3/28 73/49.8
2008/0296025 A1 12/2008 Inderberg et al.
(Continued)

FOREIGN PATENT DOCUMENTS

WO WO 2006/062512 A1 6/2006
WO WO 2015/023807 A1 2/2015
WO WO 2015/191417 A1 12/2015

*Primary Examiner* — Crystal J. Lee
(74) *Attorney, Agent, or Firm* — Norman B. Thot

(57) ABSTRACT

An assembly includes two tubular elements, a primary and a secondary seal arranged between the two tubular elements, a seal cavity formed between the two tubular elements and the primary and the secondary seal, and a seal monitoring apparatus having a housing and a position sensor. The housing has a chamber enclosing a separator which divides the chamber into a first and a second sub-chamber. The first sub-chamber is fluidly connected to the seal cavity and is filled with a hydraulic fluid. The separator is movable in a first direction relative to the housing to increase a volume of the first sub-chamber and decrease a volume of the second sub-chamber, and in a second direction to decrease the volume of the first sub-chamber and increase the volume of the second sub-chamber. The position sensor generates an electrical signal which represents a position of the separator relative to the housing.

15 Claims, 5 Drawing Sheets

(56) References Cited

U.S. PATENT DOCUMENTS

| | | | |
|---|---|---|---|
| 2010/0289225 | A1 | 11/2010 | Lafleur et al. |
| 2012/0267119 | A1 | 10/2012 | Patel |
| 2016/0201448 | A1 | 7/2016 | Patel |
| 2017/0183956 | A1 | 6/2017 | Taylor et al. |

* cited by examiner

APPARATUS FOR AND METHOD OF MONITORING A DRILLING INSTALLATION

CROSS REFERENCE TO PRIOR APPLICATIONS

This application is a U.S. National Phase application under 35 U.S.C. § 371 of International Application No. PCT/NO2021/050005, filed on Jan. 8, 2021 and which claims benefit to Great Britain Patent Application No. 2000272.1, filed on Jan. 9, 2020. The International Application was published in English on Jul. 15, 2021 as WO 2021/141499 A1 under PCT Article 21(2).

FIELD

The present invention relates to an apparatus for and method of monitoring a drilling installation.

When a connection is made to a bore in a drilling installation, it is necessary to provide a seal between the connector and the tubular surrounding the bore. This applies to the seals in subsea tie-in systems which provide connections between subsea infrastructure, such as Christmas trees or manifolds, and flow-lines, umbilicals, modules and pipelines for import and export of oil or gas, or to seals between a tubular which is located in the bore of an outer housing, such as a wellhead or tubing spool.

Before the system in which the seal is provided is used, it is necessary to test the integrity of the seal, and this can be done in two ways, by pressurizing the bore, or by pressurizing a cavity at the exterior side of the seal (hereinafter referred to as the "back-seal"). Both of these methods are time consuming and require various degrees of intervention. Pressurizing the back-seal is generally preferred because it is less time consuming than pressurizing the bore, and the testing can be carried out immediately after the connection is made. In contrast, testing by pressurizing the bore can only be carried out once the pressure integrity of the remainder of the bore has been established. Pressurizing the back-seal requires ROV intervention, however, and provides an inferior assessment of the seal, particularly for pressure-assisted seals, as they are not pressurized in the same way as when in use.

WO 2006/962512 describes a deepwater seal test apparatus for use in testing an apparatus with first and second components that are sealed by a primary seal and an external barrier seal. The test apparatus has a pressure chamber which is connected to a source of pressure, a suction chamber which is connectable to the cavity between the primary seal and external barrier seal, and a piston, one side of which is exposed to the pressure chamber, and the other side of which is exposed to the suction chamber. The apparatus is operated by supplying pressure to the pressure chamber to move the piston to increase the volume of the suction chamber and create a vacuum therein. When the apparatus is connected to the cavity between the two seals, this vacuum is communicated to the volume. The ability of the two seals to prevent ingress of liquid into the cavity is determined by monitoring the pressure in the cavity or the position of the piston. This test method is described as being applied to the seals between a tubing hanger and a Christmas tree, but could equally be used to test the seals between a wellhead, a Christmas tree, a flow loop, a flowline, a jumper, a riser or a pipeline.

The seal may be subject to external loading once in use. For example, a tie-in system is subjected to external loading from the flow-line/umbilical/module or pipe-line to which it is connected. This could affect the integrity of the seal and the reliability of the overall system. It is therefore desirable to quantify this loading, and to use this information in numerical models and evidence from testing to determine, for example, the likely operational window and/or mean time to fail of the system, and to run diagnostics on the system.

US 2016/0201448 describes a method of monitoring load forces at various locations along a variety of downhole completions. A compensating piston forms a fluid chamber between a housing and a mandrel of one of the completions, the mandrel being slidable with respect to the housing. A pressure sensor is provided to measure the pressure of the fluid in the fluid chamber, and this pressure measurement is used to determine the load forces on the completion, for example, during the landing of an up-hole completion on a downhole completion.

SUMMARY

An aspect of the present invention is to provide an improved apparatus for and a method of testing and monitoring a seal in a drilling installation.

In an embodiment, the present invention provides an assembly which includes two tubular elements, a primary seal and a secondary seal arranged between the two tubular elements, a seal cavity formed between the two tubular elements, the primary seal and the secondary seal, and a seal monitoring apparatus comprising a housing and a position sensor. The housing comprises a chamber wherein is arranged a separator. The separator divides the chamber into a first sub-chamber and a second sub-chamber. The first sub-chamber is fluidly connected to the seal cavity and is filled with a hydraulic fluid. The separator is movable in a first direction relative to the housing so as to increase a volume of the first sub-chamber and to decrease a volume of the second sub-chamber, and in a second direction relative to the housing so as to decrease the volume of the first sub-chamber and to increase the volume of the second sub-chamber. The position sensor is configured to generate an electrical signal which represents a position of the separator relative to the housing.

BRIEF DESCRIPTION OF THE DRAWINGS

The present invention is described in greater detail below on the basis of embodiments and of the drawings in which.

DETAILED DESCRIPTION

Figure 1:
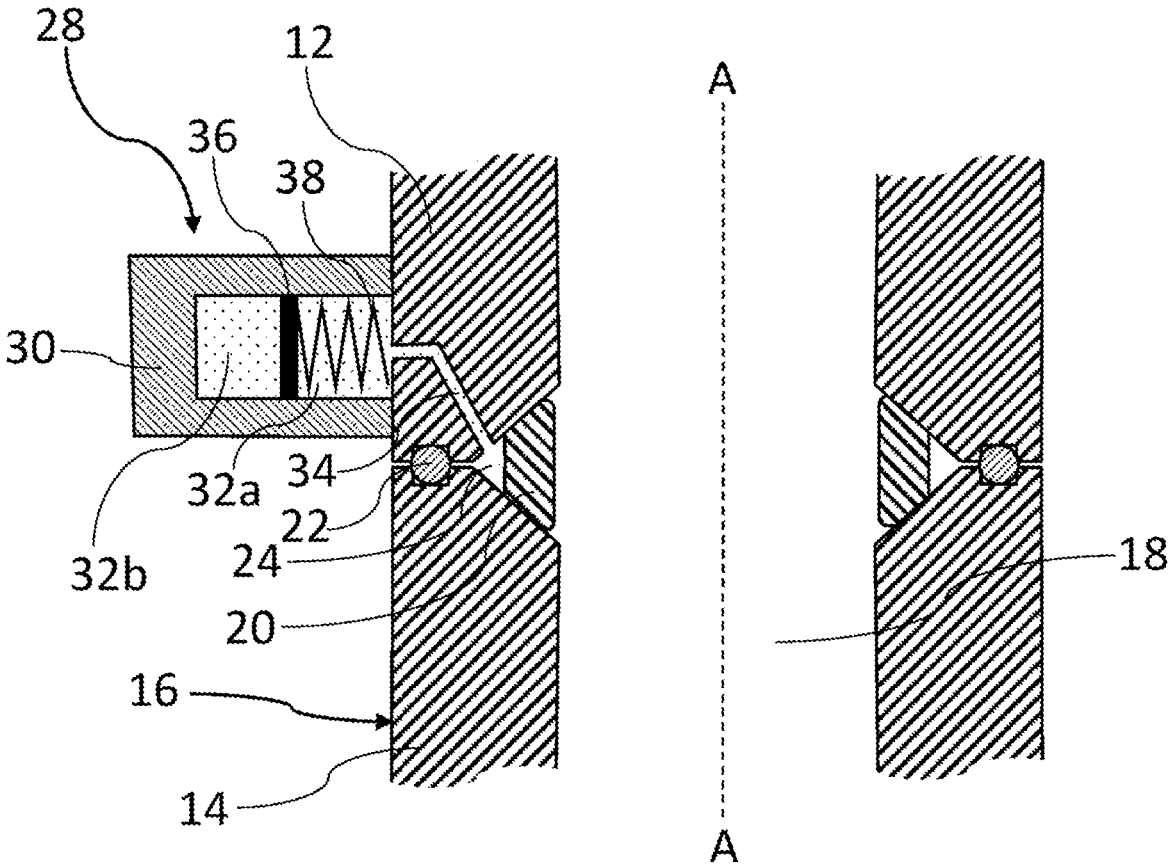
FIG. 1 is a schematic illustration of a seal assembly and seal monitoring apparatus according to a first aspect of the present invention.

A first aspect of the present invention provides an assembly comprising two tubular elements with primary and secondary seals therebetween, there being a seal cavity formed between the two tubular elements and the primary and secondary seals, the assembly further comprising a seal monitoring apparatus comprising a housing having a chamber in which is located a separator which divides the chamber into a first sub-chamber and a second sub-chamber, the first sub-chamber being fluidly connected to the seal cavity and filled with a hydraulic fluid, the separator being movable in a first direction relative to the housing to increase the volume of the first sub-chamber and to decrease the volume of the second sub-chamber and in a second direction to decrease the volume of the first sub-chamber and to increase the volume of the second sub-chamber, wherein the seal monitoring apparatus further includes a position sensor which is configured to generate an electrical signal which represents the position of the separator relative to the housing.

The housing and separator can, for example, be configured so that the chamber is only divided into two sub-chambers, i.e., the first sub-chamber and the second sub-chamber.

The separator may comprise a piston.

The second sub-chamber may be filled with a compressible fluid. The housing may alternatively comprise a vent port which connects the second sub-chamber to an atmosphere at the exterior of the housing.

The position sensor is advantageously configured to transmit a signal indicative of the position of the separator to a processor at a location remote from the seals.

The first sub-chamber can, for example, be connected to the seal cavity via a conduit through one of the tubular elements.

The seal monitoring apparatus advantageously includes a restrictor device which can be activated to prevent movement of the separator relative to the housing, and be deactivated to allow for a movement of the separator relative to the housing.

The housing may be provided with a port which provides a conduit from the exterior of the housing into the first sub-chamber, and a plug or valve which is operable to close the port.

The housing may be integral with one of the tubular elements.

The seal monitoring apparatus further comprises a resilient biasing element, such as a spring, which extends between the separator and the housing and which is configured to exert a biasing force on the separator which urges the separator to move in the first direction relative to the housing. The resilient biasing element may be located in either the first sub-chamber or in the second sub-chamber.

A second aspect of the present invention provides a drilling installation comprising two tubular elements with primary and secondary seals therebetween, there being a seal cavity formed between the two tubular elements and the primary and secondary seals, the drilling installation further comprising a seal monitoring apparatus having any feature of the seal monitoring apparatus of the first aspect of the present invention.

A third aspect of the present invention provides a method of monitoring seals in an assembly comprising two tubular elements with primary and secondary seals therebetween, there being a seal cavity between two tubular elements and the primary and secondary seals, wherein the method comprises securing a seal monitoring apparatus to one of the tubular elements, the seal monitoring apparatus having a housing which encloses a chamber in which is located a separator which divides the chamber into a first sub-chamber and a second sub-chamber, the first sub-chamber being fluidly connected to the seal cavity and filled with a hydraulic fluid, the separator being movable in a first direction relative to the housing to increase the volume of the first sub-chamber and to decrease the volume of the second sub-chamber and in a second direction to decrease the volume of the first sub-chamber and to increase the volume of the second sub-chamber, wherein the method comprises using a position sensor to monitor the position of the separator in the housing.

A fourth aspect of the present invention provides a method of monitoring loading of two tubular elements in an assembly comprising the two tubular elements with primary and secondary seals therebetween, there being a seal cavity between two tubular elements and the primary and secondary seals, wherein the method comprises securing a seal monitoring apparatus to one of the tubular elements, the seal monitoring apparatus having a housing which encloses a chamber in which is located a separator which divides the chamber into a first sub-chamber and a second sub-chamber, the first sub-chamber being fluidly connected to the seal cavity and filled with a hydraulic fluid, the separator being movable in a first direction relative to the housing to increase the volume of the first sub-chamber and to decrease the volume of the second sub-chamber and in a second direction to decrease the volume of the first sub-chamber and to increase the volume of the second sub-chamber, wherein the method comprises using a position sensor to monitor the position of the separator in the housing.

The seal monitoring apparatus used in the methods according to the second and third aspects of the present invention may have any feature or combination of features of the seal monitoring apparatus in the assembly of the first aspect of the present invention.

Embodiments of the present invention will now be described, by way of example only, with reference to the accompanying drawings.

Figure 2:
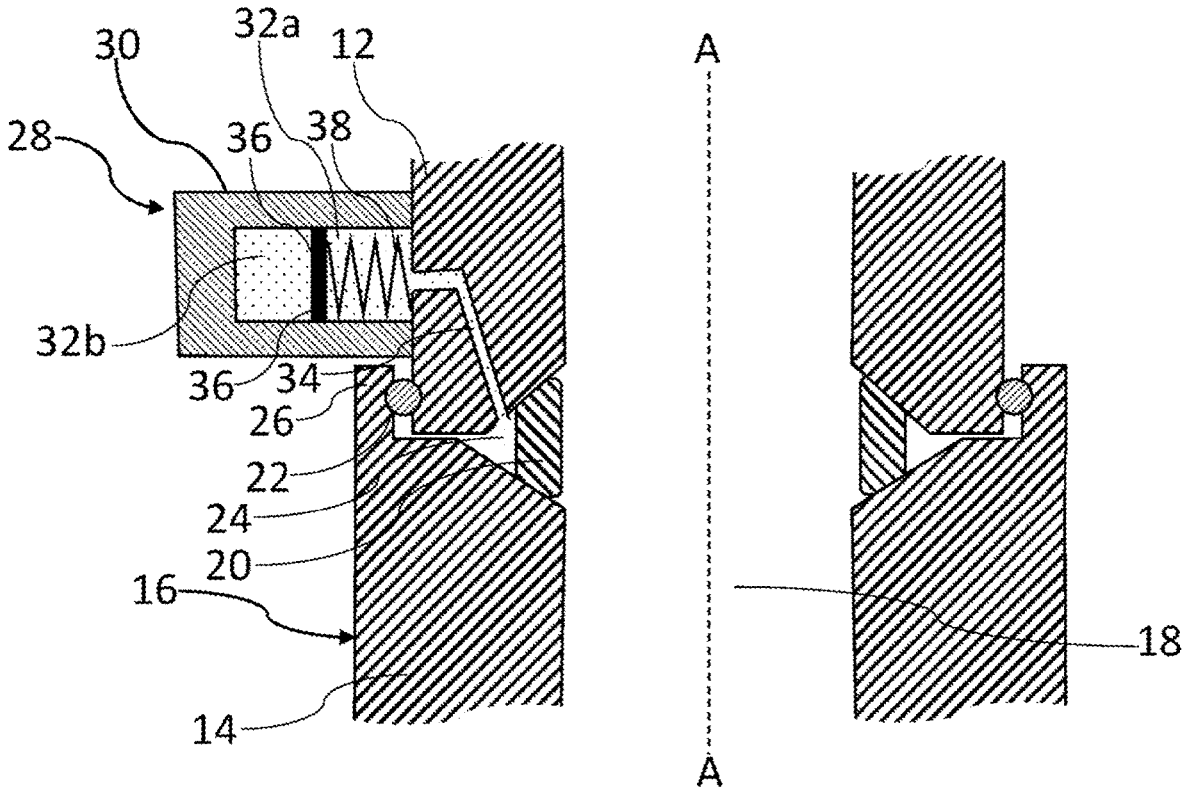
FIG. 2 is a schematic illustration of a second embodiment of a seal assembly and seal monitoring apparatus according to the first aspect of the present invention.

Referring now to FIGS. 1 and 2, there is shown a seal assembly which is configured to provide a substantially fluid tight seal between two tubular elements 12, 14 which are connected end to end to form a tubular 16 which encloses an interior passage 18 with a longitudinal axis A, so that fluid in the interior passage 18 (hereinafter referred to as bore fluid) cannot leak through the joint between the two tubular elements 12, 14 to the exterior of the tubular 16.

The seal assembly comprises a primary seal 20 which is located between the two ends of the tubular elements 12, 14 to provide the first barrier against ingress of bore fluid into the joint between the two tubular elements 12, 14, and a secondary seal 22 which is also located between the two ends of the tubular elements 12, 14 to provide a second barrier which prevents any bore fluid which has managed to leak past the primary seal 20 from entering the environment at the exterior of the tubular 16. The secondary seal 22 also acts as a first barrier, and the primary seal 20 as a second barrier, against ingress of fluid at the exterior of the tubular 16 (hereinafter referred to as external fluid) into the interior passage 18 of the tubular 16 via the joint between the two tubular elements 12, 14.

The primary seal 20 may be a pressure activated seal which is configured so that the force with which it is urged into engagement with the two ends of the tubular elements 12, 14 increases as the pressure of the bore fluid increases relative to the pressure of the exterior fluid. The secondary seal 22 may be a pressure activated seal which is configured so that the force with which it is urged into engagement with the two ends of the tubular elements 12, 14 increases as the pressure of the exterior fluid increases relative to the pressure of the bore fluid. In an embodiment, however, the secondary seal is, for example, not pressure activated, and is simply an elastomeric O-ring or some other equivalent passive sealing element.

There is a seal cavity 24 formed in the space between the two ends of the tubular elements 12, 14 and the primary and secondary seals 20, 22.

In the seal assembly illustrated in FIG. 1, the secondary seal 22 is located between two end faces of the two tubular elements 12, 14 which are generally perpendicular to the longitudinal axis A of the interior passage 18, while in the embodiment illustrated in FIG. 2, the secondary seal 22 is located between an exterior face of a first one of the tubular elements 12, and a radially inward facing surface of an extension part 26 of a second one of the tubular elements 14 which is located around the perimeter of the first tubular element 12. In the embodiment illustrated in FIG. 2, the secondary seal 22 is therefore located between and engages with two faces which lie generally parallel to the longitudinal axis A of the interior passage 18.

Figure 3:
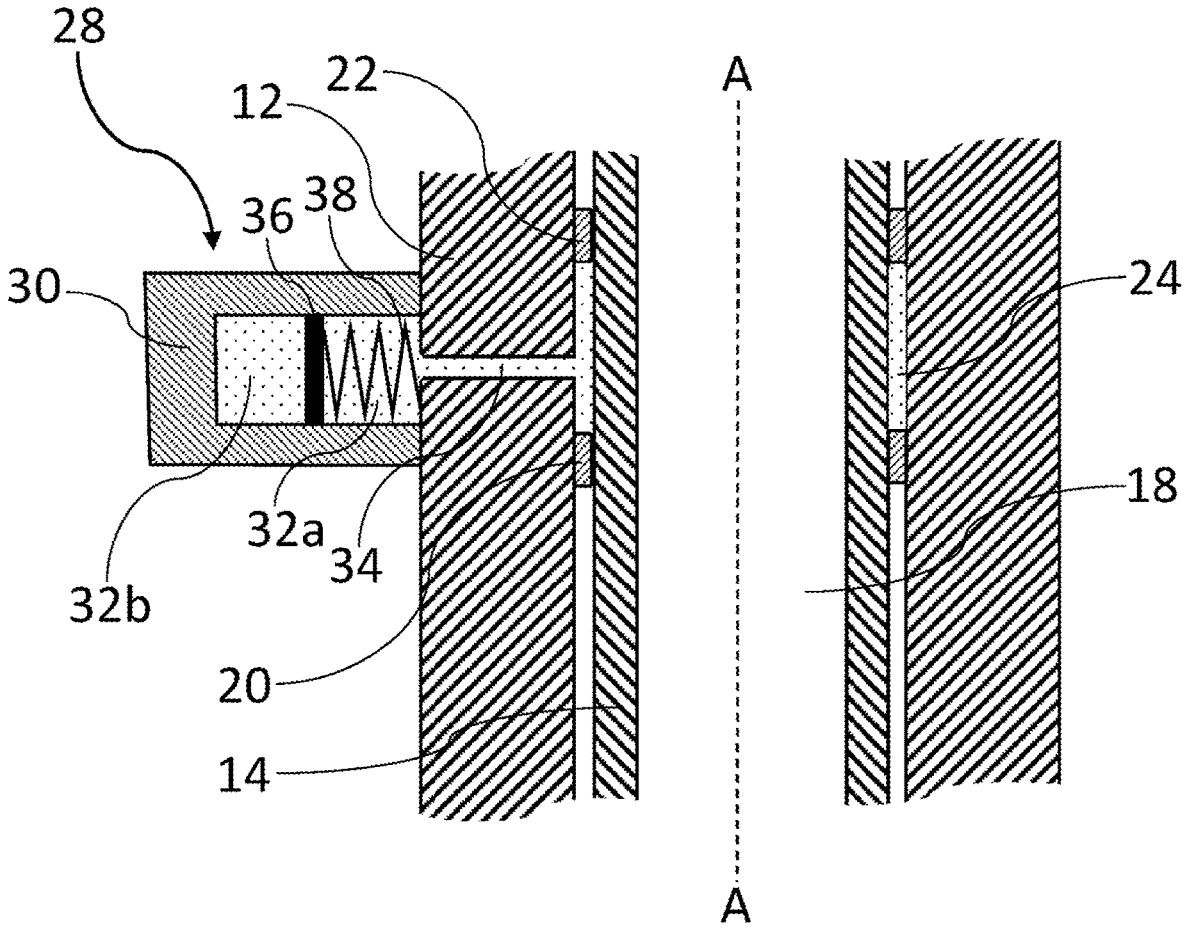
FIG. 3 is a schematic illustration of a third embodiment of a seal assembly and seal monitoring apparatus according to the first aspect of the present invention.

A further alternative arrangement of seal assembly is illustrated in FIG. 3. In this case, the second tubular element 14 is inside the first tubular element 12, and primary and secondary seals 20, 22 are located between and engage with an exterior surface of the second tubular element 14 and an interior surface of the first tubular element 12.

Such sealing arrangements may be found in subsea installations used in oil and/or gas drilling and production, for example, between subsea infrastructure such as wellheads, Christmas trees, flow spools, risers and other tubular components such as flow-lines, umbilicals, modules and pipelines, tubing hangers, and casing hangers. The present invention can be used in any such application, and further comprises a seal monitoring apparatus 28 as illustrated in FIGS. 1-3.

The seal monitoring apparatus 28 comprises a housing 30 which encloses a pressure chamber. The pressure chamber is connected to the seal cavity 24 via a conduit 34 through the first one of the tubular elements 12. The housing 30 can, for example, be secured to or be integral with the first one of the tubular elements 12.

The pressure chamber is divided into two sub-chambers 32*a* 32*b* by a separator, which in this example is a floating piston 36, which engages with the housing 30 to provide a substantially fluid tight seal preventing the flow of fluid between the two sub-chambers 32*a*, 32*b*, while being movable relative to the housing 30 so that the volumes of the sub-chambers 32*a*, 32*b* is variable. Movement of the floating piston 36 in a first direction increases the volume of a first one of the sub-chambers 32*a* and decreases the volume of a second one of the sub-chambers 32*b*, while movement of the floating piston 36 in a second direction decreases the volume of the first sub-chamber 32*a* and increases the volume of the second sub-chamber 32*b*. The first sub-chamber 32*a* is connected to the seal cavity 24 via the conduit 34.

The seal monitoring apparatus 28 further comprises a resilient biasing element, spring 38, which is arranged to act on the floating piston 36 to urge the floating piston 36 to move in the first direction relative to the housing 30. In this embodiment, the spring 38 is a helical compression spring which is located in the first sub-chamber 32*b* and which extends between the floating piston 36 and an end face of the housing 30 to push the floating piston 36 in the first direction. It will be appreciated that the spring 38 could equally be located in the second sub-chamber 32*b* and configured to pull the floating piston 36 in the first direction.

The housing 30 is also provided with at least one vent port (not shown) which is open and which connects the second sub-chamber 32*b* to the surrounding environment.

The seal monitoring apparatus 28 is further provided with a position sensor (not shown) which is configured to generate a position signal which is indicative of the position of the floating piston 36 relative to the housing 30. The position sensor can, for example, be an electronic/electrical position sensor which may be connected, either by a wired communication link or by a wireless connection, to an electronic processor, and which is configured to transmit the position signal to the processor. The position sensor can, for example, also be configured to be activated or de-activated remotely, so that it only acts to determine the position of the floating piston 36 and/or transmit a position signal to the processor when activated.

The seal monitoring apparatus 28 further comprises a restrictor device (not shown) which can be activated to prevent a movement of the floating piston 36 relative to the housing 30, and de-activated to allow a movement of the floating piston 36 relative to the housing 30. In an embodiment, the restrictor device can, for example, be activated locally to the seal monitoring apparatus 28, for example, via an ROV which engages with the restrictor device on the housing 30. The restrictor could, however, be configured so that it can be activated and de-activated remotely. For example, it could be an electro-mechanical device which is connected by a wired or wireless connection to the processor.

Once the seal assembly is assembled ready for use, the seal monitoring apparatus 28 can be used to test the integrity of the seal assembly, in particular the primary seal 20, both prior to use of the sealing assembly, and during its use, as will be described below.

While the seal assembly is assembled, the restrictor device is activated to prevent movement of the floating piston 36 relative to the housing 30. If the seal between the two tubular elements 12, 14 is made up under water, during this process, the seal cavity 24, the conduit 34, and the first and second sub-chambers 32*a*, 32*b* in the housing 30 of the seal monitoring apparatus 28 fill with water at the prevailing hydrostatic pressure. The restrictor device is then de-activated so that the floating piston 36 is free to move relative to the housing 30 under the action of the spring 38 to increase the volume of the first sub-chamber 32*a* and to decrease the volume of the second sub-chamber 32*b*. The seal monitoring apparatus 28 is then ready to be used to monitor the seal assembly without the need for any further physical intervention in the region of the seal assembly.

If it is found that the seal cavity 24, the conduit 34, and first and second sub-chambers 32*a*, 32*b* do not fill with water completely during the make-up of the seal, and some air remains trapped in one or more of these regions, it may be necessary to provide the housing 30 with a vent port (not shown) which extends through the housing 30 to connect the first sub-chamber 32*a* with the surrounding environment. The vent port may be provided with a plug which can be inserted using an ROV to close the port, or, for example, a valve which is operable to open or close the port. The valve could be a two-way valve with a valve member which normally closes the charging port, but which can be actuated mechanically, for example, using an ROV, or remotely via an electrical control signal, to open or close the vent port. If such a vent port is provided, it would be closed after the seal is made up and before or at the same time as the restrictor device is de-activated. If the vent port is closed using an electrically operated valve, and the restrictor is activated or de-activated via an electrical control signal from a remote location, the system could be set up so that the same electrical control signal closes the vent port and de-activates the restrictor. One or both operations could alternatively be carried out using an ROV.

As the first sub-chamber 32*a* is connected to a closed system (namely, the conduit 34 and the seal cavity 24) if the integrity of seal assembly is good, movement of the piston 36 in the first direction under the action of the spring 38 would create a vacuum in the first sub-chamber 32*a*/conduit 34/seal cavity 24, and is therefore prevented. If, however, the primary seal 20 is not functioning properly, fluid can flow from the interior passage 18, across the primary seal 20, and into the seal cavity 24, thus allowing the floating piston 36 to move under the action of the spring 38 to increase the volume of the first sub-chamber 32*a*. Similarly, if the secondary seal 22 is not functioning properly, fluid can flow from the exterior of the tubular 16, across the secondary seal 22, and into the seal cavity 24, which will also allow the floating piston 36 to move under the action of the spring 38. The integrity of the seal can therefore be monitored by activating the position sensor and using the signal received from the position sensor to detect a movement of the floating piston 36. If no piston movement is detected, the seals provided by the primary and secondary seals 20, 22 are good, and the seal assembly is ready for use. If, on the other hand, there is movement of the floating piston 36, that means that there is leakage across one or both of the primary or secondary seals 20, 22 and the seal assembly should be made good before it can be put to use.

The seal monitoring apparatus 28 can also be used to monitor the integrity of the seal assembly during use by re-activating the position sensor at any point in time. If the position sensor detects movement of the piston 36, this again demonstrates that the integrity of the seal assembly has been compromised and requires repair or replacement, while if no movement is detected, the integrity of the seal assembly is good.

This monitoring can be conducted continuously, but is advantageously carried out at regular intervals during use of the seal assembly, by de-activating the restrictor device and activating the position sensor.

It is also possible to use the seal monitoring apparatus as described above to test/monitor the integrity of a seal in a top-side connection. In this case, however, as there is no ambient liquid to fill the seal cavity 22, conduit 34 and first sub-chamber 32*a*, it is necessary to inject a hydraulic fluid into these regions after the seal is made-up. This could be done via a charging port which provides a connection to the first sub-chamber 32*a*, and which is provided with a plug which can be used to close the port, or, for example, via a valve which is operable to open or close the port. The valve could be a one-way valve which is operable to allow flow of fluid into the first sub-chamber 32*a* but not to allow flow of fluid out of the sub-chamber 32*a*, or it could be a two-way valve with a valve member which normally closes the charging port, but which can be actuated mechanically, for example, using a stab connector, to open the charging port. The restrictor device would be activated while injecting the hydraulic fluid, and the charging port would be closed and the restrictor device de-activated once the first sub-chamber 32*a*, seal cavity 22, and conduit 34 are filled with hydraulic fluid. The seal monitoring apparatus at this point functions in exactly the same way as described above.

It would also be advantageous in this case to provide the housing 30 with a vent port which also connects the first sub-chamber 32*a* to the exterior of the housing 30, and which has a plug or valve which is operable to open or close the vent port. The valve could be a one-way valve which operable to allow a flow of fluid out of the sub-chamber 32*a*, but not to allow a flow of fluid into the first sub-chamber 32*a*. Air trapped in the seal cavity 22/conduit 34 or first sub-chamber 32*a* can thus be exhausted through the vent port when displaced by the injected hydraulic fluid.

Where used in a top-side location, it may be more convenient to test the integrity of the seal using conventional methods, such as by pressurizing the interior passage 18, with the seal monitoring apparatus only being used to monitor the integrity of the seal during a use of the system.

The seal monitoring apparatus 28 can be built into new drilling systems as described above or retrofitted onto already installed drilling systems. Where a hot stab connection to the seal cavity 24 (as is conventional) is already provided, the latter can be achieved by mounting the seal monitoring apparatus 28 on the exterior surface of one tubular element 12, 14 so that the first sub-chamber 32*a* is connected to the seal cavity 24 via the existing hot stab connection. If no such-hot stab connection is provided, installation of the seal monitoring apparatus 28 would involve the creation of a new conduit to connect to the seal cavity 24.

Figure 4:
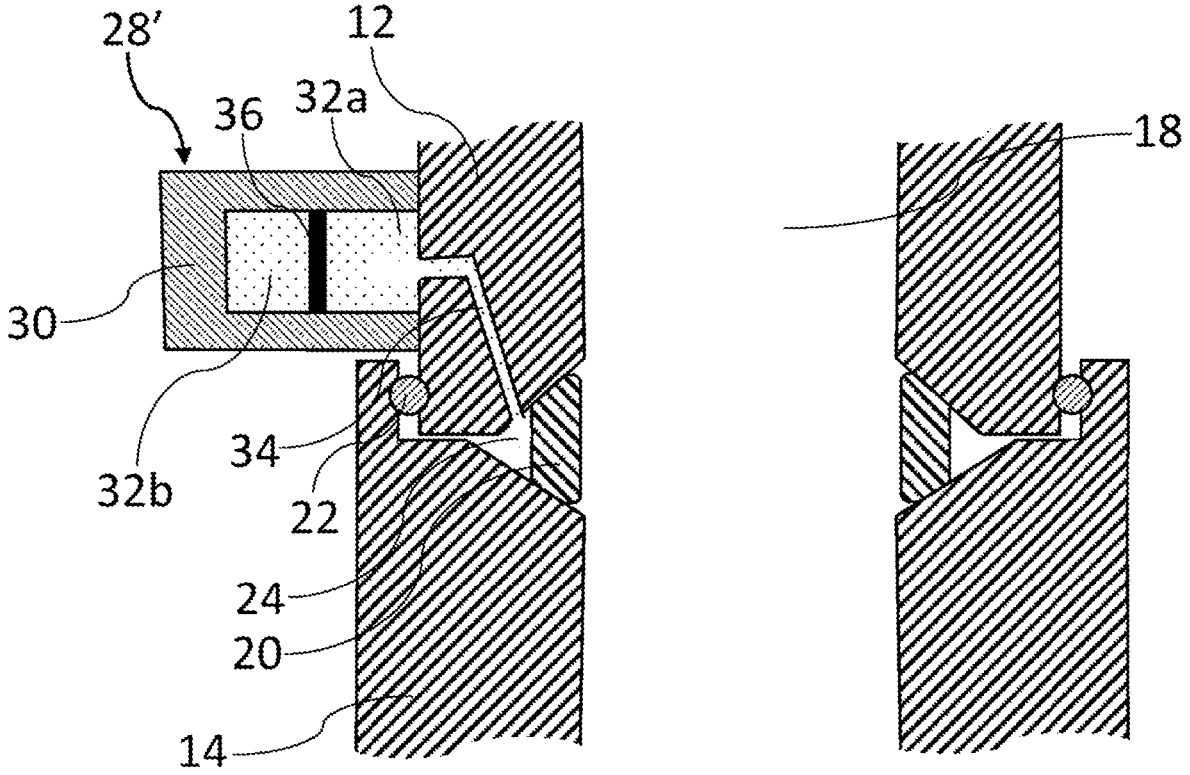
FIG. 4 is a schematic illustration of a seal assembly and seal monitoring apparatus according to a third aspect of the present invention.
Figure 5:
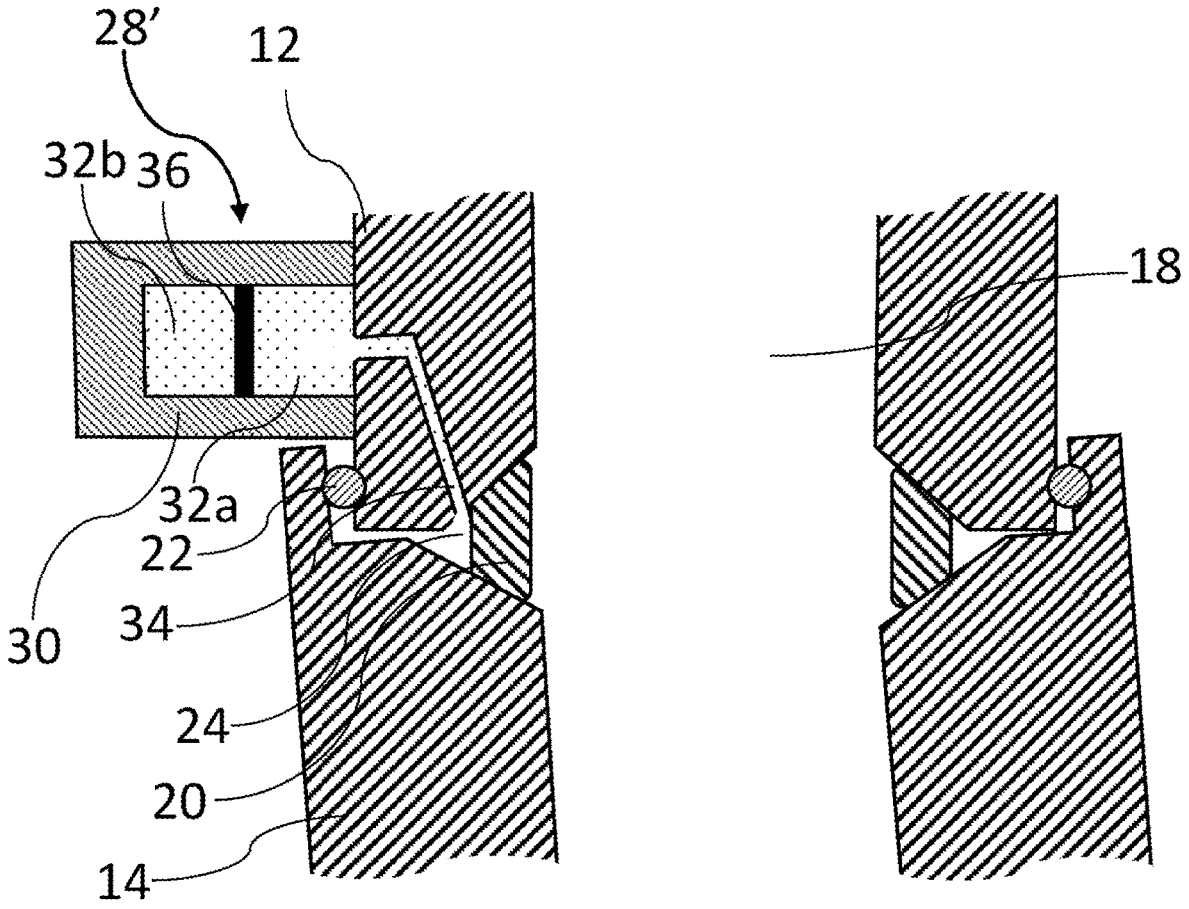
FIG. 5 is a schematic illustration of the seal assembly and seal monitoring apparatus illustrated in FIG. 4 as used in the method according to a fourth aspect of the present invention.

Referring now to FIGS. 4 and 5, these show an alternative embodiment of a seal monitoring apparatus 28' used in conjunction with the type of seal assembly shown and described in relation to FIG. 2. This embodiment of the seal monitoring apparatus 28' is exactly the same as the seal monitoring apparatus 28 shown in and described in relation to FIGS. 1, 2 and 3, except that no spring is provided. The seal monitoring apparatus 28' can be built into new drilling systems, or retrofitted onto already installed drilling systems. Where a hot stab connection to the seal cavity 24 (as is conventional) is already provided, the latter can be achieved by mounting the seal monitoring apparatus 28' on the exterior surface of one tubular element 12, 14 so that the first sub-chamber 32*a* is connected to the seal cavity 24 via the existing hot stab connection. If no such-hot stab connection is provided, installation of the seal monitoring apparatus 28' would involve the creation of a new conduit to connect to the seal cavity 24.

When the seal assembly is ready for use, the restrictor device is de-activated, so that the floating piston 36 is free to move in the housing 30, and the position sensor is activated.

Loading of the tubular elements 12, 14 can cause them to move relative to one another, and this can cause the volume of the seal cavity 24 to change. This is illustrated in FIG. 5, which shows the second tubular element 14 pivoted anti-clockwise relative to the first tubular element 12. Any such increase in the volume of the seal cavity 24 will cause hydraulic fluid to be drawn into the seal cavity 24 from the first sub-chamber 32*a*, and the floating piston 36 to move in the second direction. Similarly, any decrease in the volume of the seal cavity 24 will cause hydraulic fluid to be ejected from the seal cavity 24 into the first sub-chamber 32*a*, and the floating piston 36 to move in the first direction. The more relative movement there is between the first tubular element 12 and the second tubular element 14, the greater the volume change, and therefore the greater the movement of the floating piston 36. By activating the position sensor to monitor the position of the floating piston 36, a relative movement between the first tubular element 12 and the second tubular element 14 can thus be detected, and quantified.

The present invention is not limited to embodiments described herein; reference should be had to the appended claims.

LIST OF REFERENCE NUMERALS

12 Tubular element
14 Tubular element
16 Tubular
18 Interior passage
20 Primary seal
22 Secondary seal
24 Seal cavity
26 Extension part
28 Seal monitoring apparatus
28' Seal monitoring apparatus
30 Housing
32*a* First sub-chamber
32*b* Second sub-chamber
34 Conduit
36 Separator/Floating piston
38 Resilient biasing element/Spring
A Longitudinal axis

What is claimed is:

1. An assembly comprising:
two tubular elements;
a primary seal and a secondary seal arranged between the two tubular elements;
a seal cavity formed between the two tubular elements, the primary seal and the secondary seal; and
a seal monitoring apparatus comprising a housing and a position sensor,
the housing comprising a chamber wherein is arranged a separator, the separator dividing the chamber into a first sub-chamber and a second sub-chamber, the first sub-chamber being fluidly connected to the seal cavity and being filled with a hydraulic fluid, the separator being movable in a first direction relative to the housing so as to increase a volume of the first sub-chamber and to decrease a volume of the second sub-chamber, and in a second direction relative to the housing so as to decrease the volume of the first sub-chamber and to increase the volume of the second sub-chamber, and
the position sensor being configured to generate an electrical signal which represents a position of the separator relative to the housing.

2. The assembly as recited in claim 1, wherein the housing and the separator are configured so that the chamber is only divided into the first sub-chamber and the second sub-chamber.

3. The assembly as recited in claim 1, wherein the separator is a floating piston.

4. The assembly as recited in claim 1, wherein the second sub-chamber is filled with a compressible fluid.

5. The assembly as recited in claim 1, wherein the housing further comprises a vent port which connects the second sub-chamber to an atmosphere at an exterior of the housing.

6. The assembly as recited in claim 1, wherein the position sensor is further configured to transmit the electrical signal which represents the position of the separator relative to the housing to a processor at a location which is remote from the primary seal and the secondary seal.

7. The assembly as recited in claim 1, further comprising:
a conduit which is arranged through one of the two tubular elements,
wherein,
the first sub-chamber is connected to the seal cavity via the conduit.

8. The assembly as recited in claim 1, wherein the seal monitoring apparatus further comprises a restrictor device which is configured to be activated to prevent a movement of the separator relative to the housing, and de-activated to allow a movement of the separator relative to the housing.

9. The assembly as recited in claim 1, wherein the housing further comprises,
a port which is configured to provide a conduit from an exterior of the housing into the first sub-chamber, and
a plug or a valve which is configured to close the port.

10. The assembly as recited in claim 1, wherein the housing is arranged to be integral with one of the two tubular elements.

11. The assembly as recited in claim 1, wherein the seal monitoring apparatus further comprises a resilient biasing element which extends between the separator and the housing, the resilient biasing element being configured to exert a biasing force on the separator so as to urge the separator to move in the first direction relative to the housing.

12. The assembly as recited in claim 11, wherein the resilient biasing element is arranged in either the first sub-chamber or in the second sub-chamber.

13. A drilling installation comprising:
two tubular elements;
a primary seal and a secondary seal arranged between the two tubular elements;
a seal cavity formed between the two tubular elements, the primary seal and the secondary seal; and
the seal monitoring apparatus as recited in claim 1.

14. A method of monitoring seals in an assembly, the assembly comprising:
two tubular elements;
a primary seal and a secondary seal arranged between the two tubular elements; and
a seal cavity formed between the two tubular elements, the primary seal and the secondary seal,
the method comprising:
securing a seal monitoring apparatus to one of the two tubular elements, the seal monitoring apparatus comprising a housing which comprises a chamber wherein is arranged a separator, the separator dividing the chamber into a first sub-chamber and a second sub-chamber, the first sub-chamber being fluidly connected to the seal cavity and being filled with a hydraulic fluid, the separator being movable in a first direction relative to the housing so as to increase a volume of the first sub-chamber and to decrease a volume of the second sub-chamber, and in a second direction relative to the housing so as to decrease the volume of the first sub-chamber and to increase the volume of the second sub-chamber; and
using a position sensor to monitor a position of the separator in the housing.

15. A method of monitoring a loading of two tubular elements in an assembly, the assembly comprising:
the two tubular elements;
a primary seal and a secondary seal arranged between the two tubular elements; and
a seal cavity formed between the two tubular elements, the primary seal and the secondary seal,
the method comprising:
securing a seal monitoring apparatus to one of the two tubular elements, the seal monitoring apparatus comprising a housing which comprises a chamber wherein is arranged a separator, the separator dividing the chamber into a first sub-chamber and a second sub-chamber, the first sub-chamber being fluidly connected to the seal cavity and being filled with a hydraulic fluid, the separator being movable in a first direction relative to the housing so as to increase a volume of the first sub-chamber and to decrease a volume of the second sub-chamber, and in a second direction relative to the housing so as to decrease the volume of the first sub-chamber and to increase the volume of the second sub-chamber; and using a position sensor to monitor a position of the separator in the housing.

* * * * *